United States Patent [19]

Staat et al.

[11] Patent Number: 4,798,071

[45] Date of Patent: Jan. 17, 1989

[54] SEAMLESS TUBE PRODUCTION

[75] Inventors: Karlhans Staat, 4030 Ratingen 8; Hermann Möltner, 4048 Grevenbroich 2, both of Fed. Rep. of Germany

[73] Assignee: Kocks Technik GmbH & Co., Hilden, Fed. Rep. of Germany

[21] Appl. No.: 63,298

[22] Filed: Jun. 17, 1987

[51] Int. Cl.[4] ..... B21B 19/04

[52] U.S. Cl. ..... 72/97

[58] Field of Search ..... 72/97, 229

[56] References Cited

U.S. PATENT DOCUMENTS 662,146 11/1900 Davis ..... 72/97

1,936,019 11/1933 Horbach et al. ..... 72/97

*Primary Examiner*—Lowell A. Larson

*Attorney, Agent, or Firm*—Buchanan Ingersoll

[57] ABSTRACT

This invention concerns a process and an arrangement for the production of seamless tube. An ingot heated to the rolling temperature is pierced in a skew-rolling stand to form a hollow ingot, is later stretched into a tube bloom and is rolled out into a finished tube. In order to improve this familiar process, it is proposed to conduct the stretching immediately after the piercing in the same heat as the latter, in which case the rolled goods is stretched in the same skew-rolling stand, but with a passage direction that is opposite to that of piercing. An arrangement with which this process according to the invention can be implemented is also proposed.

20 Claims, 2 Drawing Sheets

SEAMLESS TUBE PRODUCTION

This invention relates to seamless tube production and more properly concerns a process for the production of seamless tube, in which an ingot heated to the rolling temperature is pierced in a skew-rolling stand to form a hollow ingot, then stretched into a tube bloom and rolled out into finished tube. In the vast majority of cases the above three procedural steps are carried out during seamless tube production, with the aid of three different apparatuses. The piercing frequently takes place in a skew-rolling stand because the latter delivers a hollow ingot with a low wall thickness tolerance and a relatively great length. The stretching frequently occurs in a second skew-rolling stand, which is designed as an Assel or Diescher roll stand. The tube bloom that thus results during stretching is rolled out into finished tube after intermediate heating in a subsequent size-reducing or stretch-reduction roll train.

The piercing of ingots to hollow ingots and the stretching of hollow ingots into tube blooms with the same skew-rolling stand is already known (the Journal *Bander, Bleche, Rohre,* Vol. 14, No. 4, pp. 150–151 (1973)). With this familiar process, however, a number of hollow ingots were first produced by piercing, the skew-rolling stand was then converted from piercing to stretching and then a number of hollow ingots were further processed by stretching into tube blooms.

Because the piercing of several consecutive ingots requires a longer period of time and the conversion of the skew-rolling stand from piercing to stretching also requires some time, it is not possible to carry out the piercing and stretching in one heating in this familiar process. Thus, the hollow ingots have to be heated again prior to stretching, which is uneconomical and time-consuming, and which also requires the installation and operation of a suitable furnace.

In addition, during both piercing and stretching the rolled goods are moved from the ingot guide channel located on the entrance side through the roll stand to the exit side, where it is discharged from the side. A transport arrangement is thus required to convey the hollow ingots from the exit to the entrance side of the skew-rolling stand, which calls for the corresponding investment costs.

Furthermore, a mandrel rod is inserted into the hollow ingot on the entrance side at the beginning of the stretching process until its front end strikes the bottom of the pierced hollow ingot. The mandrel rod then pushes, in the manner of a push bench, the hollow ingot into the region of the rolls of the skew-rolling stand, where the stretching process is carried out. Consequently, a hollow ingot that is not pierced all the way through, but rather has a bottom that acts as a stopper for the mandrel rod is required in this familiar process. As a result, the piercing process in the skew-rolling stand must be stopped prematurely in order to obtain a bottom section, or the hollow ingot must be produced with a punching press. Both have the disadvantage that the substantial proportion of material must be scrapped because this bottom section must be cut off and discarded after stretching. For the above reasons, the familiar process was cumbersome, time-consuming and uneconomical and could be used only for a small production output; therefore, this process has not been widely used in practice.

The invention proposes to organize the above process in a simpler, technically better and more economical manner and to offer an arrangement that makes it possible to carry out the process according to the invention with relatively low investment costs.

This problem is solved according to the invention in that the stretching takes place immediately after piercing in the same heat, where the rolled goods is stretched in the same skew-rolling stand, but with a passage direction opposite that of piercing.

This invention process thus differs from the familiar process in that the skew-rolling stands operates for piercing and stretching in reversing roll operation and both passages quickly follow each other. The ingot is pierced during the first passage, while in the second passage and in the opposite direction the same ingot is shortly thereafter stretched in the same skew-rolling mill to form a tube bloom. As a result, no appreciable cooling occurs between piercing and stretching and an intermediate heating is not needed. There is also no need for a transport mechanism for conveying the rolled goods from the exit side to the entrance side around the skew-rolling stand. The mandrel rod guidance is simplified also because a mandrel rod and a support bearing are required only on the exit side of the skew-rolling stand. Its stroke is very short here because the mandrel rod does not have to be withdrawn from the hollow ingot; rather, the latter is rolled down during the second passage of the mandrel rod. Furthermore, the exit guidance for the hollow ingot during piercing also constitutes a good entrance guidance during stretching, in which the hollow ingot can easily rotate and is not turned by loading with a high torque.

Another advantage consists in the fact that at the beginning of piercing and stretching the maximum stress that arises then on the roll stand and rolled goods is reduced in that there is a gradual acceleration from the stopped state of the rolls or from a low roll r.p.m. to the normal operating r.p.m. Stoppage of the rolls and/or a low roll r.p.m. result without additional regulation from the reversing-roll operation according to the invention, in which the rolls must be accelerated from the stationary state at the beginning of piercing and of stretching due to the reversal in the direction of rotation of the rolls.

During piercing and stretching the mandrel rod remains inside of the hollow ingot and/or tube bloom, which prevents air, especially the oxygen of the air from penetrating into the hollow ingot and/or tube bloom and producing scale on the inner wall there. Furthermore, it is possible with the invention process to keep the space between the mandrel rod and the inner wall of the hollow ingot and/or the tube bloom particularly small because the mandrel rod does not have to be newly inserted. The small size of this gap also keeps the residual amount of air and oxygen that can still penetrate here very low so that no appreciable scaling of the inner wall occurs. Consequently, the rolling of scale particles into the inner wall is also avoided during stretching; the inner wall is thus considerably smoother.

Although the hollow ingot is generally stretched after piercing over an inner mandrel rod to form a tube bloom, in order to obtain a thinner wall with greater stretching of the rolled goods, it is quite expedient in a number of cases if the hollow ingot is stretched after piercing in a hollow pass, i.e., without an inner tool. A tube bloom with a thicker wall is then indeed obtained, but this wall thickness is within particularly narrow tolerance limits, which definitely improves the quality of the finished tube.

It is particularly recommended to finish-roll the tube bloom in a size-reducing or stretch-reduction roll train after piercing and stretching without intermediate heating. This is also rendered possible by the process according to the invention, because with it piercing and stretching follow each other very rapidly and one works with only a single inner tool, which removes heat from the rolled goods only once. Consequently, the initial rolling heat is sufficient not only for piercing and stretching, but also for the sizing and stretch-reduction rolling.

On the other hand, it is also possible to further stretch the tube bloom after piercing and stretching in the reversing-roll stand in one or more subsequent procedural steps. A relieving of the load on the subsequent stretching units and particularly thin walled tube blooms is achieved in this manner. Plug mill or pilger roll stands, for example, can be used for the subsequent procedural steps for stretching.

The invention also concerns an arrangement for carrying out the invention process. This has a skew-rolling stand, which is equipped on the entrance side with an ingot guide channel and a pusher and on the exit side with a rolling mandrel on a mandrel rod that is rotatable, axially displaceable and supported in a bearing, in which case a sizing roll train or stretch-reduction roll train is located beyond the skew-rolling stand. According to the invention, this arrangement is characterized in that the drive as well as the position of the rolls and possibly the position of the guides of the skew-rolling stand can be adjusted at will after each passage to piercing or stretching and the other direction of passage of the rolled goods and that a mechanism for carrying off the stretched tube bloom is located in the zone of the ingot guide channel. Various embodiment forms can be used as skew-rolling stands, but primarily Assel and Diescher roll stands. With the latter the speed of the Diescher disks is about 4–20 times greater during stretching than during piercing. It was found that it is quite possible in such skew-rolling stands to design the adjustment devices for the positions of the rolls and possibly also the guides, such as the Diescher disks, so that they can be adjusted from stretching to piercing or from piercing to stretching within a few seconds. The radial position and/or the angle adjustment of the axes of rotation of the rolls must be primarily modified in order to set the skew rolling stand to the other shaping process. The drive speeds and the direction of rotation of the drive can, if necessary, also be modified within a few seconds. A few structural changes are required for this as compared with the familiar skew-rolling stands, but they can be done. If the adjusting devices for setting the rolls are designed so that they can also work against the rolling force, i.e., with inserted rolled goods, the rolls are then also in the position without pushing equipment to draw the rolled goods into the pass opening at the beginning of the next roll passage.

In a preferred embodiment of the invention the acute angles of attack of the rolls enclosed by the longitudinal axis of the rolled goods and an axis of rotation of the rolls during piercing and stretching have a vertex that is located on the entrance side of the skew-rolling stand equipped with the ingot guide channel. The definition of entrance and exit sides always refers only to the piercing process in this text. The result here is that the rolled goods during piercing passes through a roll pass with roll rotation axes with a divergent extension—with reference to the direction of passage—while during stretching it is passed through a roll pass with convergent axes of rotation of the rolls. This reduces an undesirable turning of the rolled goods during piercing and favors its expansion. During stretching the then convergent roll rotation axis setting effects a restriction in the expansion and thus advantageously also prevents the development of cornered tube bloom ends in the case of thin rolled goods walls. In order to achieve these advantages, no other direction of inclination need be imparted to the roll rotation axes in the reversing rolls according to the invention because the change from divergent to convergent arrangement occurs only through the reversal of the direction of passage of the rolled goods. Thus, all that is required after a passage of the rolled goods is to change the size of the angle of attack of the rolls. It is recommended that the angle of attack be between one and ca. twenty degrees, where the higher degree numbers are set during piercing. It is also expedient to install the drive motors for rolling on the side of the mandrel rod support bearing.

It is advantageous if a guide tube that is rotatable around its longitudinal axis is installed beyond, coaxial to the axis of rolled goods passage as a device for carrying off the stretched tube bloom of the ingot guide channel on the side facing away from the skew-rolling stand. Such a guide tube is already the object of an older patent application (DE-OS No. 35 33 119), the use of which is also proposed here.

It is recommended here that the mandrel rod be passed through the roll pass at a controlled speed at the beginning of stretching and extend into the entrance zone of the guide tube, where it is held with the aid of the support bearing at least until the tube bloom enters into the guide tube. This means that the mandrel rod is run into the guide tube at the beginning of the stretching process by a controlled displacement of the support bearing through the region of the rolls and is not retained until in this position; the beginning of the stretched tube bloom is thus also flawlessly brought in the zone of the ingot guide channel and is reliably entered into the entrance opening of the guide tube. As soon as the latter occurs, the mandrel rod can be gradually withdrawn during the stretching process to the exit side, but which can also occur after the stretching process is complete.

In an advantageous embodiment of the invention a shaft rod that drives the mandrel rod, is coaxially coupled with the latter and is supported in the bearing is provided with a larger outside diameter than the hollow ingots as a pusher for the latter at the beginning of stretching. Pushing of the hollow ingots into the region of the rolls thus takes place during stretching without additional structural expenditure through the shaft rod that is present and thus relieves the strongly stressed zone on this side of the skew-rolling stand. Due to the large outside diameter of the shaft rod, a radial buttressing against buckling is also unnecessary.

In another embodiment of this invention the roll component that effects the expansion during piercing is utilized during stretching for smoothing the rolled goods. This central roll component remains relatively spared during piercing, such that it is also useable after a prolonged operating time for stretching in which higher requirements are imposed on the precision and surface quality of the rolled goods. In addition, the roll component that effects the reduction during piercing is provided during stretching for rounding the tube bloom, and vice versa.

There is also the possibility of changing the direction of passage of the rolled goods by modifying the feed angle of the rolls. In this manner, a reversal of the direction of rotation of the roll drive can be avoided, during which substantial moments of inertia arise, whereby a braking and restarting of the drive in the opposite direction of rotation becomes costly and time-consuming. A change in the feed angle of the rolls makes it possible to work in the reverse-rolling operation according to the invention without changing the direction of roll rotation.

It is expedient to have a lower passage speed of the rolled goods during piercing than during stretching. The greater torque required during piercing leads in the case of an appropriately lower passage speed to approximately the same power requirement of the drive as stretching that requires a lesser torque with a correspondingly higher passage speed. In the ideal case the same installed drive power can be fully utilized in both piercing and stretching.

Finally, it is advisable to provide a separating device for cropping the end sections of the tube blooms in front of the sizing or stretch-reduction roll train. This is recommended because the tube bloom end sections are uneven after piercing and stretching, which can lead to disturbances during finish-rolling.

The invention is illustrated in the drawings on the basis of one preferred example.

Figure 1:
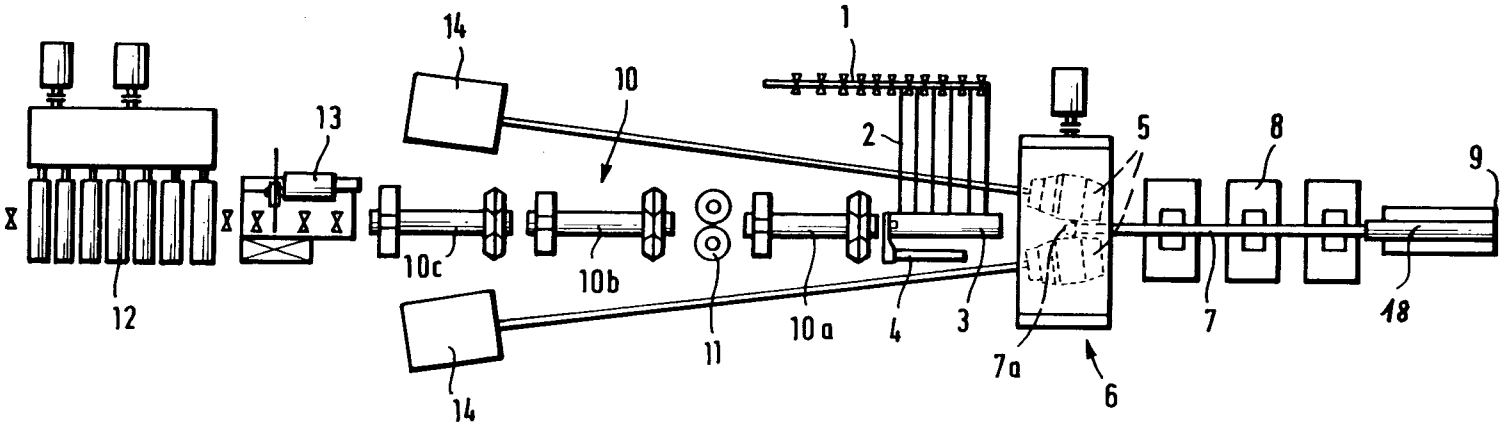
FIG. 1 shows an arrangement according to the invention in top view.

In FIG. 1 an ingot heated to the rolling temperature passes from a furnace, not shown, over a roller bed 1 and a transverse conveyor 2 into an ingot guide channel 3. A pusher 4 there moves the ingot in the axial direction out of the ingot guide channel 3 between the rolls 5 of a skew-rolling stand 6. From the discharge side a mandrel rod 7 with rolling mandrel 7*a* projects into the zone of the rolls 5, where the mandrel rod 7 is guided and held in the radial direction by a mandrel rod and hollow ingot guide 8 and in the axial direction by a shaft rod 18 and by a support bearing 9. The shaft rod 18 has an outside diameter that is greater than that of the hollow ingots 15. It also serves as a pusher for the hollow ingots 15 at the beginning of stretching.

Figure 2:
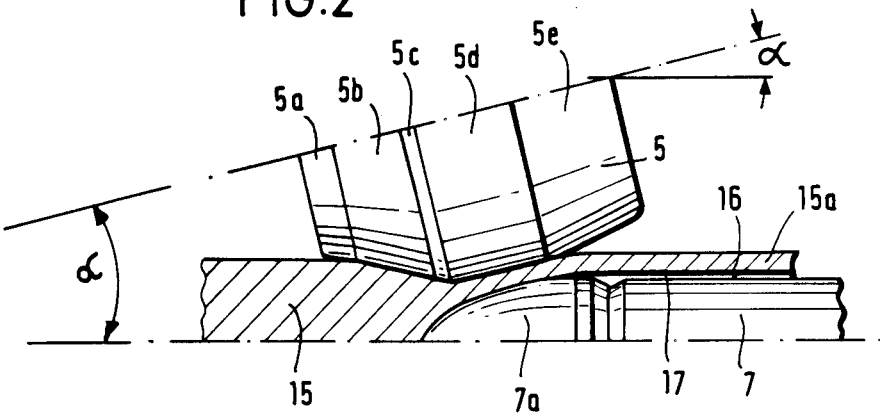
FIG. 2 shows an inclined roll during piercing.

During piercing the ingot is rolled onto the mandrel rod 7, where a lubricant and/or a deoxidizing agent is expediently introduced through the mandrel rod 7 and possibly also through the roll mandrel 7*a* into the inner hole 16 of the rolling ingot 15*a*—see FIG. 2.

As soon as the stretching of the resulting hollow ingot enclosing the mandrel rod 7 is completed, the hollow ingot is stretched by the same rolls 5 to form a tube bloom and in so doing is conveyed back in the opposite direction to the ingot guide channel 3. The mandrel rod 7, with or without its roll mandrel 7*a* which is somewhat greater in diameter and may have been removed, is moved here to the ingot guide channel 3 in the axial direction by an appropriately regulated advance of the support bearing 9. This occurs until the roll mandrel 7*a* is located in the entrance zone of the first section 10*a* of the guide tube 10. The roll mandrel 7*a* remains in the entrance zone of the guide tube section 10*a* at least until the front part of the tube bloom has run in there. Then the mandrel rod 7 with the roll mandrel 7*a* can be slowly withdrawn with the aid of the support bearing 9 and the shaft rod 18. This is possible even during stretching, but to the extent that the roll mandrel 7*a* still remains on the side of the rolls 5 facing the ingot guide channel 3. Only after completion of the stretching process can the mandrel rod 7 and shaft rod 18 be withdrawn into the position shown in FIG. 1, in which the piercing process for the next ingot is begun.

The stretched tube bloom is moved through the guide tube sections 10*a*, 10*b*, 10*c*, with the aid of driving rollers 11 to a sizing or stretch-reduction roll train 12. The tube bloom is rolled out there into a finished tube. A separating device 13 is provided in front of the sizing or stretch-reduction roll train 12; it is possible with it to crop a portion of the tube bloom end sections if this should be necessary due to size deviations or irregularities in shape at the ends.

The rolls of the skew-rolling stand are driven by the motors in a familiar manner through long drive shafts. They and the motors 14 can also be located on the other side of the skew-rolling stand 6 facing the support bearing 9, so that the apices of the angle of attack formed by the roll rotation axes are on the entrance side, approximately in the region of the ingot guide channel 3. The rolls 5 are then also set in the opposite manner, as shown in FIG. 1, inclined with regard to the longitudinal axis of the rolled goods. In order to change the direction of passage, there is first the possibility of changing the direction of rotation of the motors 14. There is also the possibility of modifying only the feed angle of the rolls 5. This feed angle is not detectable in the patent drawings. It is the angle between the paper plane and the rotation axis of the rolls 5. The axes of rotation of the rolls 5 in skew rolling stands are not parallel to the shop floor or to the paper plane of FIG. 1, but are inclined to them by a few degrees. If this inclination is changed into the opposite direction, the feed direction of the rolls 5 and thus the direction of rolled goods passage are also changed.

FIG. 2 shows a roll 5 in larger scale and represented with a different direction of inclination than in FIG. 1 during piercing. Here the roll mandrel 7*a* of the mandrel rod 7 penetrates into the ingot 15 and produces an inner hole 16. It can be clearly seen that only a narrow annular space is present between the mandrel rod 7 and the inside wall 17 of the inner hole 16, in which there is only very little air and practically no oxygen. The roll has a front section 5*a* that serves to draw the ingot 15 into the pass. A connected more conical section 5*b* causes a reduction in the ingot cross section and a roll shoulder 5*c* and the cylindrical section 5*d*, which serve to pierce and expand the rolled goods, then follow. The last section 5*e* of the roll 5 induces a rounding of the resulting hollow ingot 15*a*.

Figure 3:
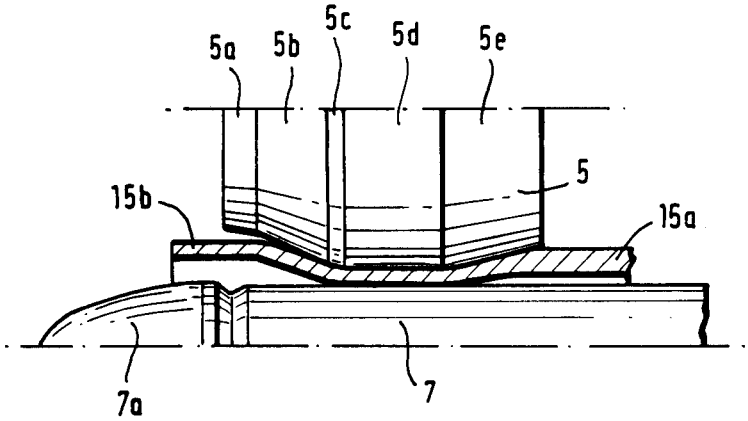
FIG. 3 shows an inclined roll during stretching.

The same roll 5 is shown in FIG. 3 during the stretching of the hollow ingot 15*a* to form a tube bloom 15*b*. The roll mandrel 7*a* is advanced through the pass opening formed by the rolls 5, in which case the cylindrical section 5*d* of the rolls 5, which serves to induce expansion during piercing, is used during the stretching shown in FIG. 3 for smoothing and calibrating the wall thickness of the tube bloom, together with the mandrel rod 7. The roll section 5*e*, which was used during piercing only for rounding, is used during stretching according to FIG. 3 for reducing the wall thickness and at the same time for drawing the hollow ingot 15*a* into the pass. The latter task is taken over during piercing by the roll section 5*a*, which wears relatively rapidly due to the usual unevenness of the ingot 15, the rotation acceleration to be applied, rolling work and the variable speeds. As is clearly evident in FIG. 3, this roll section 5*a* no longer comes in contact with the finished tube bloom 15*b* so that the unevenness caused by this roll section 5*a* that may exhibit wear phenomena need no longer be feared. The roll position in FIG. 3 has been substantially modified in comparison to that in FIG. 2 due to the fact that the angle of attack $\alpha$ has become almost zero and a corresponding radial incidence resulted, which essentially determines the wall thickness of the tube bloom 15*b*.

However, it should be indicated that other roll positions are applicable during both piercing and stretching and other roll shapes can also be used.

In the foregoing specification we have set out certain preferred practices and embodiments of our invention, however, it will be understood that this invention may be otherwise embodied within the scope of the following claims.

We claim:

1. Process for seamless tube production comprising (a) heating an ingot to rolling temperature;

(b) piercing said ingot to form a hollow tube in a pass opening having an axis defined by a mandrel and rolls in a skew rolling mill;

(c) reversing the direction of rotation of said rolls and stretching said hollow tube by passing said hollow tube in reverse direction through said same rolling mill and along said same axis to form a tube bloom;

(d) said stretching taking place immediately after piercing during the same heat.

2. The process of claim 1 employing a mandrel in said stretching step.

3. The process of claim 1 without employing a mandrel in said stretching step.

4. The process of claim 1 including a first cross rolling step to feed said ingot to said rolling mill and a second cross rolling step to remove said tube bloom from said rolling mill.

5. Process according to claim 1 wherein said tube bloom is finish-rolled after piercing and stretching without intermediate heating in a sizing and stretching reduction roll mill train.

6. Process according to claim 1 wherein the tube bloom is further stretched after piercing and stretching in one or more subsequent steps.

7. An apparatus for seamless tube production comprising a skew-rolling stand, an ingot guide channel and a pusher on the inlet side of said skew rolling stand, a roll mandrel on a mandrel rod that can be rotated and/or axially displaced, said mandrel rod supported in a bearing on the exit side of said skewed-rolling stand, skewed rolls having attached drive means operatively positioned with respect to said mandrel, the direction of rotation of the rolls and said drive means being reversible so that an ingot passed one direction through said apparatus becomes pierced to form a hollow tube and so that said hollow tube passed in reverse direction through said apparatus upon a reversal of rotation direction becomes stretched to form a tube bloom.

8. Apparatus according to claim 7 wherein the position of the rolls and the drive means is adjustable.

9. Apparatus according to claim 7 wherein the position of the rolls and the drive means is fixed.

10. Apparatus according to claim 7 wherein the acute angles of attack enclosed by the longitudinal axis of the rolled goods and an axis of roll rotation of the rolls have a vertex during piercing and stretching that is located on the entrance side of the skew-rolling stand that is equipped with the ingot guide channel.

11. Apparatus according to claim 10 wherein the angle of attack is between one and about twenty degrees, and a larger angle is set during piercing than during stretching.

12. Apparatus according to claim 10 or 11 wherein drive motors for the rolls are located on the side of the mandrel rod support bearing.

13. Apparatus according to claim 7 or 10 or 11 wherein a guide tube that is rotatable around its longitudinal central axis is located coaxially subsequent to the axis of rolled goods passage as a device for carrying off the stretched tube bloom of the ingot guide channel on the side facing away from the skew-rolling stand.

14. Apparatus according to claim 13 wherein at the beginning stretching, the mandrel rod is moved through the roll pass in a speed-controlled manner and penetrates into the entrance zone of the guide tube, where it is held with the aid of the support bearing at least until the tube bloom enters into the guide tube.

15. Apparatus according to claim 7 or 10 or 11 wherein a shaft rod that drives the mandrel rod is coaxially coupled with the mandrel rod and is supported in the bearing is provided with a larger outside diameter than the hollow ingots as a pusher for the hollow ingots at the beginning of the stretching.

16. Apparatus according to claim 7 or 10 or 11 wherein the roll component that effects the expansion during piercing is provided during stretching for smoothing the rolled goods.

17. Apparatus according to claim 7 or 10 or 11 wherein the roll component that effects the reduction during piercing is provided during stretching for rounding the tube bloom and vice versa.

18. Apparatus according to claim 7 or 10 or 11 wherein the direction of passages of the rolled goods can be changed by modifying the feed angle of the rolls.

19. Apparatus according to claim 7 or 10 or 11 wherein the speed of passage of the rolled goods is lower during piercing than during stretching.

20. Apparatus according to claim 7 or 10 or 11 wherein a separating device for cropping the end sections of the tube bloom is located in front of the sizing or stretching reduction rolling train.

* * * * *

UNITED STATES PATENT AND TRADEMARK OFFICE

CERTIFICATE OF CORRECTION

PATENT NO. : 4,798,071

DATED : January 17, 1989

INVENTOR(S) : KARLHANS STAAT, HERMANN MOLTNER

It is certified that error appears in the above-identified patent and that said Letters Patent is hereby corrected as shown below:

Column 7, line 57, Claim 7, after "passed" insert --in--.

Signed and Sealed this

Eighteenth Day of July, 1989

*Attest:*

*Attesting Officer*

DONALD J. QUIGG

*Commissioner of Patents and Trademarks*